US008602098B2

(12) United States Patent
Kwan et al.

(10) Patent No.: US 8,602,098 B2
(45) Date of Patent: Dec. 10, 2013

(54) HYDRATE CONTROL IN A CYCLIC SOLVENT-DOMINATED HYDROCARBON RECOVERY PROCESS

(75) Inventors: Mori Y. Kwan, Calgary (CA); Rahman Khaledi, Calgary (CA); Robert D. Kaminsky, Houston, TX (US); Mark S. Beckman, Houston, TX (US); Robert Chick Wattenbarger, Houston, TX (US); J. Pierre Lebel, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 496 days.

(21) Appl. No.: 12/987,720

(22) Filed: Jan. 10, 2011

(65) Prior Publication Data

US 2011/0198086 A1 Aug. 18, 2011

(30) Foreign Application Priority Data

Feb. 16, 2010 (CA) ..... 2693036

(51) Int. Cl.
*E21B 43/22* (2006.01)
*E21B 43/24* (2006.01)

(52) U.S. Cl.
USPC ..... 166/250.01; 166/263; 166/272.1; 166/272.3; 166/272.4; 166/305.1; 166/310

(58) Field of Classification Search
None
See application file for complete search history.

(56) References Cited

U.S. PATENT DOCUMENTS 2,412,765 A 12/1946 Buddrus et al.
3,954,141 A 5/1976 Allen et al.
4,007,787 A 2/1977 Cottle
4,008,764 A 2/1977 Allen
4,424,866 A 1/1984 McGuire
4,819,724 A 4/1989 Bou-Mikael et al.
5,025,863 A 6/1991 Haines et al.
5,076,364 A * 12/1991 Hale et al. ..... 166/310
5,407,009 A 4/1995 Butler et al.

(Continued)

FOREIGN PATENT DOCUMENTS

CA 1015656 8/1977
CA 1059432 7/1979

(Continued)

OTHER PUBLICATIONS

Black, L., (2003) "VAPEX—a new propane market," *Propane Canada*, May/Jun. 2003; Found on the Internet in May 2011 at the following link: http://findarticles.com/p/articles/mi_ga5410/is_200305/ai_n21332180/.

(Continued)

*Primary Examiner* — George Suchfield
(74) *Attorney, Agent, or Firm* — ExxonMobil Upstream Research Company—Law Department

(57) ABSTRACT

The present invention relates generally to in situ hydrate control during hydrocarbon production when applying a recovery method utilizing cyclic injection of light hydrocarbon solvents. Hydrate formation is limited by creating an energy reserve within a hydrocarbon reservoir adjacent to the wellbore. A heated solvent is injected during an injection phase of a cyclic solvent dominated recovery process to form a heated region adjacent to the wellbore at the end of an injection cycle. The energy reserve is used to act against the evaporative cooling effect caused by subsequent production and associated depressurization to maintain reservoir conditions outside of hydrate formation conditions. In situ conditions are estimated and injected energy amounts are controlled.

28 Claims, 1 Drawing Sheet

(56) References Cited

U.S. PATENT DOCUMENTS

| | | | | |
|---|---|---|---|---|
| 5,491,269 | A * | 2/1996 | Colle et al. | 585/15 |
| 5,607,016 | A | 3/1997 | Butler | |
| 5,674,816 | A | 10/1997 | Loree | |
| 5,725,054 | A | 3/1998 | Shayegi et al. | |
| 5,771,973 | A * | 6/1998 | Jensen et al. | 166/303 |
| 6,039,116 | A | 3/2000 | Stevenson et al. | |
| 6,214,175 | B1 | 4/2001 | Heinemann et al. | |
| 6,318,464 | B1 | 11/2001 | Mokrys | |
| 6,405,799 | B1 | 6/2002 | Vallejos et al. | |
| 6,769,486 | B2 | 8/2004 | Lim et al. | |
| 6,883,607 | B2 | 4/2005 | Nenniger et al. | |
| 6,978,837 | B2 | 12/2005 | Yemington | |
| 7,165,621 | B2 | 1/2007 | Ayoub et al. | |
| 7,363,973 | B2 | 4/2008 | Nenniger et al. | |
| 7,540,951 | B2 | 6/2009 | Selmen et al. | |
| 2003/0015321 | A1 * | 1/2003 | Lim et al. | 166/263 |
| 2009/0145606 | A1 | 6/2009 | Hocking | |
| 2010/0012331 | A1 * | 1/2010 | Larter et al. | 166/401 |

FOREIGN PATENT DOCUMENTS

| | | |
|---|---|---|
| CA | 1122115 | 4/1982 |
| CA | 2108349 | 11/1993 |
| CA | 2108723 | 4/1995 |
| CA | 2141112 | 7/1996 |
| CA | 2147079 | 10/1996 |
| CA | 2243105 | 8/1999 |
| CA | 2281276 | 2/2001 |
| CA | 2304938 | 2/2001 |
| CA | 2306016 | 10/2001 |
| CA | 2349234 | 11/2002 |
| CA | 2351148 | 12/2002 |
| CA | 2462359 | 9/2005 |
| EP | 2 022 936 | 2/2009 |
| WO | WO 2008/007099 | 6/2008 |

OTHER PUBLICATIONS

Boberg, T.C., et al. (1966) "Calculation of the production of a thermally stimulated well", *Journal of Petroleum Technology*, vol. 18, No. 12 1613-1623, December.

Butler, R.M., et al. (1993) "Recovery of Heavy Oils Using Vapourized Hydrocarbon Solvents: Further Development of the Vapex Process", The Journal of Canadian Petroleum Technology, June, vol. 32, No. 6.

Feali, M. et al., (2008) "Feasibility Study of the Cyclic VAPEX Process for Low Permeable Carbonate Systems", International Petroleum Technology Conference Paper 12833; Dec. 3-5, Kuala Lumpur, Malaysia.

Katz et al.;(1959) "Handbook of Natural Gas Engineering"; McGraw-Hill Bk. Co., p. 212.

Lim, G.B. et al., (1995) "Cyclic Stimulation of Cold Lake Oil Sand with Supercritical Ethane", SPE Paper 30298, SPE International Heavy Oil Symposium; Jun. 19-21, Calgary, Alberta, Canada.

Lim, G.B., et al., (1996) "Three-dimensional Scaled Physical Modeling of Solvent Vapour Extraction of Cold Lake Bitumen", *The Journal of Canadian Petroleum Technology*, 35(4), pp. 32-40, Apr. 1996; SPE/CIM/CANMET International Conference on Recent Advances in Horizontal Well Applications, Mar. 20-23, Calgary, Canada.

Sloan Jr., E.D. (1998); "Clathrate Hydrate of Natural Gasses", 2nd ed.; Marcel Dekker, Inc.; New York; pp. 162, 170, 200-201, 269, 520.

* cited by examiner

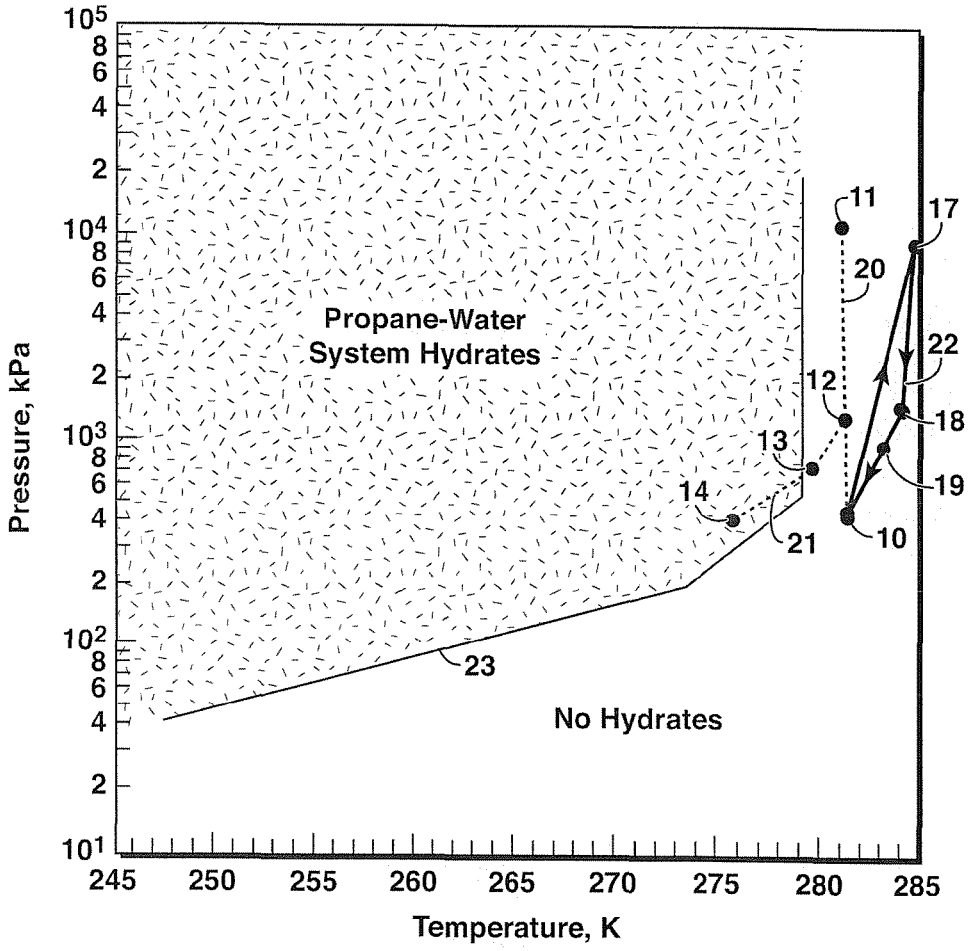
Pressure, kPa
Temperature, K
Propane-Water
System Hydrates
No Hydrates
10
11
12
13
14
17
18
19
20
21
22
23

HYDRATE CONTROL IN A CYCLIC SOLVENT-DOMINATED HYDROCARBON RECOVERY PROCESS

CROSS-REFERENCE TO RELATED APPLICATION

This application claims priority from Canadian Patent Application 2,693,036 filed Feb. 16, 2010 entitled HYDRATE CONTROL IN A CYCLIC SOLVENT-DOMINATED HYDROCARBON RECOVERY PROCESS, the entirety of which is incorporated by reference herein.

FIELD OF THE INVENTION

The present invention relates generally to hydrocarbon production and more specifically to in situ hydrate control during hydrocarbon production when applying a recovery method utilizing cyclic injection of viscosity-reducing solvents.

BACKGROUND OF THE INVENTION

At the present time, solvent-dominated recovery processes (SDRPs) are rarely used to produce highly viscous oil. Highly viscous oils are produced primarily using thermal methods in which heat, typically in the form of steam, is added to the reservoir. Cyclic solvent-dominated recovery processes (CSDRPs) are a subset of SDRPs. A CSDRP is typically, but not necessarily, a non-thermal recovery method that uses a solvent to mobilize viscous oil by cycles of injection and production. Solvent-dominated means that the injectant comprises greater than 50% by mass of solvent or that greater than 50% of the produced oil's viscosity reduction is obtained by chemical solvation rather than by thermal means. One possible laboratory method for roughly comparing the relative contribution of heat and dilution to the viscosity reduction obtained in a proposed oil recovery process is to compare the viscosity obtained by diluting an oil sample with a solvent to the viscosity reduction obtained by heating the sample.

In a CSDRP, a viscosity-reducing solvent is injected through a well into a subterranean viscous-oil reservoir, causing the pressure to increase. Next, the pressure is lowered and reduced-viscosity oil is produced to the surface through the same well through which the solvent was injected. Multiple cycles of injection and production are used. In some instances, a well may not undergo cycles of injection and production, but only cycles of injection or only cycles of production.

CSDRPs may be particularly attractive for thinner or lower-oil-saturation reservoirs. In such reservoirs, thermal methods utilizing heat to reduce viscous oil viscosity may be inefficient due to excessive heat loss to the overburden and/or underburden and/or reservoir with low oil content.

References describing specific CSDRPs include: Canadian Patent No. 2,349,234 (Lim et al.); G. B. Lim et al., "Three-dimensional Scaled Physical Modeling of Solvent Vapour Extraction of Cold Lake Bitumen", The Journal of Canadian Petroleum Technology, 35(4), pp. 32-40, April 1996; G. B. Lim et al., "Cyclic Stimulation of Cold Lake Oil Sand with Supercritical Ethane", SPE Paper 30298, 1995; U.S. Pat. No. 3,954,141 (Allen et al.); and M. Feali et al., "Feasibility Study of the Cyclic VAPEX Process for Low Permeable Carbonate Systems", International Petroleum Technology Conference Paper 12833, 2008.

The family of processes within the Lim et al. references describes embodiments of a particular SDRP that is also a cyclic solvent-dominated recovery process (CSDRP). These processes relate to the recovery of heavy oil and bitumen from subterranean reservoirs using cyclic injection of a solvent in the liquid state which vaporizes upon production. The family of processes within the Lim et al. references may be referred to as CSP™ processes.

One complication of using light solvents is that they readily form gas clathrates at high pressures, such as those existing in subsurface oil reservoirs, and at lower temperatures, such as can exist in shallow reservoirs in cool climates (e.g., bitumen reservoirs in Alberta, Canada). Gas clathrates, which are also referred to as "gas hydrates" or just "hydrates", are similar to water ice and comprise solid-phase water in which one of several lattice structures act as the molecular cages to trap to 'guest' molecules. Hydrates can be formed with many 'guest' molecules, however, it is the hydrates of methane, ethane, propane, butane, and carbon dioxide which are of greatest importance for this discussion. The conditions at which hydrates will form depend on many factors including temperature, pressure, and composition. Hydrates are well known to be stable over a wide range of high pressures (generally at least several atmospheres) and near ambient temperatures (as described, for instance, in Katz et al.; *Handbook of Natural Gas Engineering*; McGraw-Hill Bk. Co., p. 212; 1959). Specific hydrate formation conditions are composition dependent. For example, methane forms solid hydrates with pure water at temperatures above 0° C. at pressures greater than about 2.5 MPa, whereas propane forms solid hydrates with pure water at temperatures of about 0° C. at pressures greater than about 0.16 MPa.

Hydrates may be either naturally occurring or man-made. Man-made hydrates are typically created during oil and gas production and processing when the phase boundary of hydrates is unintentionally encroached. Man-made hydrates are often a nuisance due to their tendency to plug pipes and equipment. If hydrates are inadvertently formed in situ during recovery of oil and gas, significant reduction of productivity may occur. This may be a particular issue if low molecular weight solvents, e.g., ethane, propane, or carbon dioxide, are injected into relatively cold oil-bearing formations to aid productivity.

Lim et al. in U.S. Pat. No. 6,769,486 and Canadian Patent No. 2,349,234 disclose a cyclic solvent process for in situ bitumen and heavy oil production. In the process, a light hydrocarbon solvent, such as ethane or propane, is injected in a liquid-phase into the reservoir and produced through a common wellbore at least in part in a vapor-phase. Lim et al. teaches using a hydrate inhibitor to prevent hydrates in wellbores and "that conditions of the oil sand reservoirs are such that hydrates are less likely to form in the reservoir during injection and production phases." However, under some reservoir conditions, hydrate formation can reduce permeability, especially in the near-wellbore region. Lim et al. disclose that the solvent may be injected in a heated state in a preferred temperature range of 10-50° C. However, Lim et al. does not teach that this is done or optimized for controlling hydrates, especially in situ. Moreover, methods to assess how much heat to add are not disclosed. Thus, a need exists to limit or prevent hydrate formation within an oil reservoir undergoing cyclic solvent injection, especially in the near-wellbore region. Moreover, there is a need to do this in a manner to minimize cost and energy usage.

SUMMARY OF THE INVENTION

In accordance with an aspect of the present invention, hydrate formation is limited by creating an energy reserve within a hydrocarbon reservoir adjacent to a wellbore that is utilized for cyclic solvent injection and fluid production. In some embodiments, an energy carrying fluid is injected during an injection phase of a cyclic solvent dominated recovery process to form a heated region adjacent to the wellbore at the end of an injection cycle. The reserve is used to act against the evaporative cooling effect caused by subsequent production and associated depressurization to maintain reservoir conditions outside of hydrate formation conditions. In some embodiments, the energy carrying fluid may be combined with a hydrate inhibitor to further limit hydrate formation during subsequent production.

In accordance with an aspect of the present invention, there is provided a method for limiting hydrate formation during hydrocarbon production from an underground hydrocarbon reservoir using a production method involving solvent injection and cycling of in situ pressure, the method comprising: a) estimating a minimum quantity of thermal energy required to heat a near-wellbore region to a temperature above a hydrate formation temperature of a composition to be produced in subsequent production; b) injecting a viscosity-reducing solvent into the reservoir through a wellbore; c) injecting a thermal energy carrying fluid into the reservoir through the wellbore at least until the minimum quantity of thermal energy required to heat the region to the temperature above the hydrate formation temperature has been introduced; and d) subsequently producing hydrocarbons from the reservoir though the wellbore.

In certain embodiments, the following features may be present.

The estimating step may comprise determining the minimum quantity of thermal energy, and the step of injecting the thermal energy carrying fluid may be performed based on this minimum quantity of thermal energy.

The estimating step may comprise determining a minimum temperature to be reached in the region indicating that the minimum quantity of thermal energy has been introduced, and the step of injecting the thermal energy carrying fluid may be performed at least until this minimum temperature has been reached. The method may further comprise estimating the minimum temperature using a thermal reservoir simulation.

The minimum quantity of thermal energy may be a quantity of energy required to prevent the formation of hydrates during subsequent fluid production. The estimating step may comprise estimating a cooling effect caused by in situ vaporization of the solvent during planned cycling of in situ pressure. The minimum quantity of thermal energy may be a quantity of energy required to heat the region to a temperature above the hydrate formation temperature and to counteract the cooling effect caused by in situ vaporization of the solvent during planned cycling of in situ pressure such that, during production, the region remains above the hydrate formation temperature.

The hydrocarbons may be a viscous oil having an in situ viscosity of at least 10 cP (centipoise) at initial reservoir conditions.

Production rate may be temporarily limited in order to reduce an amount of cooling caused by in situ vaporization of the solvent.

The energy carrying fluid may be heated solvent and may comprise at least a portion of the viscosity-reducing solvent in step (b).

The method may comprise introducing the heat by way of the energy carrying fluid in a latter portion of an injection cycle.

The method may comprise introducing the heat by way of heating the fluids via downhole equipment.

The energy carrying fluid may comprise heated ethane, propane, butane, pentane, hexane, heptane, $CO_2$, or a mixture thereof.

The solvent may comprise ethane, propane, butane, pentane, hexane, heptane, $CO_2$, or a mixture thereof. The solvent may comprise ethane, propane, butane, pentane, carbon dioxide, or a combination thereof. The solvent may comprise greater than 50 mass % propane.

At least a portion of the solvent may enter the reservoir in a liquid state.

The energy carrying fluid may comprise greater than 50 mass % water or steam.

A hydrate inhibitor may be injected separately from or together with the energy-carrying fluid. The hydrate inhibitor may be an alcohol, glycol, or salt.

The production method may comprise: (i) injecting a volume of fluid comprising greater than 50 mass % of the viscosity-reducing solvent into an injection well completed in the reservoir; (ii) halting injection into the injection well and subsequently producing at least a fraction of the injected fluid and the hydrocarbons from the reservoir through a production well; (iii) halting production through the production well; and (iv) subsequently repeating the cycle of steps (i) to (iii). The injection well and the production well may utilize a common wellbore.

The method may further comprise monitoring at least one downhole temperature to determine a desired energy carrying fluid injection temperature.

Immediately after halting injection, at least 25 mass % of the injected solvent may be in a liquid state in the reservoir.

At least 25 mass %, or at least 50 mass %, of the solvent may enter the reservoir as a liquid.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached FIGURE, wherein:

FIG. 1 is a graph depicting a propane-water system showing a schematic of a CSDRP with (dashed) and without (solid) hydrate control.

DETAILED DESCRIPTION

The term "viscous oil" as used herein means a hydrocarbon, or mixture of hydrocarbons, that occurs naturally and that has a viscosity of at least 10 cP (centipoise) at initial reservoir conditions. Viscous oil includes oils generally defined as "heavy oil" or "bitumen". Bitumen is classified as an extra heavy oil, with an API gravity of about 10° or less, referring to its gravity as measured in degrees on the American Petroleum Institute (API) Scale. Heavy oil has an API gravity in the range of about 22.3° to about 10°. The terms viscous oil, heavy oil, and bitumen are used interchangeably herein since they may be extracted using similar processes.

In situ is a Latin phrase for "in the place" and, in the context of hydrocarbon recovery, refers generally to a subsurface hydrocarbon-bearing reservoir. For example, in situ temperature means the temperature within the reservoir. In another usage, an in situ oil recovery technique is one that recovers oil from a reservoir within the earth.

The term "formation" as used herein refers to a subterranean body of rock that is distinct and continuous. The terms "reservoir" and "formation" may be used interchangeably.

As used herein, "wellbore" or "well" includes cased, cased and cemented, or open-hole wellbores, and may be any type of well. Wellbores may be vertical, horizontal, any angle between vertical and horizontal, diverted or non-diverted, and combinations thereof, for example a vertical well with a non-vertical component.

As used herein, the "near-wellbore region" is the subterranean material and rock of the subterranean formation surrounding the wellbore, the properties of which generally affect the flow of fluids into or out of the wellbore itself, as opposed to general reservoir flow patterns. The near-wellbore region is usually, but not limited to, a radius of about one meter to as much as about 15 meters around the wellbore.

During a CSDRP, a reservoir accommodates the injected solvent and non-solvent fluid by compressing the pore fluids and, more importantly in some embodiments, by dilating the reservoir pore space when sufficient injection pressure is applied. Pore dilation is a particularly effective mechanism for permitting solvent to enter into reservoirs filled with viscous oils when the reservoir comprises largely unconsolidated sand grains. Injected solvent fingers into the oil sands and mixes with the viscous oil to yield a reduced viscosity mixture with significantly higher mobility than the native viscous oil. Without intending to be bound by theory, the primary mixing mechanism is thought to be dispersive mixing, not diffusion. Preferably, injected fluid in each cycle replaces the volume of previously recovered fluid and then adds sufficient additional fluid to contact previously uncontacted viscous oil. Preferably, the injected fluid comprises greater than 50% by mass of solvent.

On production, the pressure is reduced and the solvent(s), non-solvent injectant, and viscous oil flow back to the same well and are produced to the surface. As the pressure in the reservoir falls, the produced fluid rate declines with time. Production of the solvent/viscous oil mixture and other injectants may be governed by any of the following mechanisms: gas drive via solvent vaporization and native gas exsolution, compaction drive as the reservoir dilation relaxes, fluid expansion, and gravity-driven flow. The relative importance of the mechanisms depends on static properties such as solvent properties, native GOR (Gas to Oil Ratio), fluid and rock compressibility characteristics, and reservoir depth, but also depends on operational practices such as solvent injection volume, producing pressure, and viscous oil recovery to-date, among other factors.

During an injection/production cycle, the volume of produced oil should be above a minimum threshold to economically justify continuing operations. In addition to an acceptably high production rate, the oil should also be recovered in an efficient manner. One measure of the efficiency of a CSDRP is the ratio of produced oil volume to injected solvent volume over a time interval, called the OISR (produced Oil to Injected Solvent Ratio). Typically, the time interval is one complete injection/production cycle. Alternatively, the time interval may be from the beginning of first injection to the present or some other time interval. When the ratio falls below a certain threshold, further solvent injection may become uneconomic, indicating the solvent should be injected into a different well operating at a higher OISR. The exact OISR threshold depends on the relative price of viscous oil and solvent, among other factors. If either the oil production rate or the OISR becomes too low, the CSDRP may be discontinued. Even if oil rates are high and the solvent use is efficient, it is also important to recover as much of the injected solvent as possible if it has economic value. The remaining solvent may be recovered by producing to a low pressure to vaporize the solvent in the reservoir to aid its recovery. One measure of solvent recovery is the percentage of solvent recovered divided by the total injected. In addition, rather than abandoning the well, another recovery process may be initiated. To maximize the economic return of a producing oil well, it is desirable to maintain an economic oil production rate and OISR as long as possible and then recover as much of the solvent as possible.

The OISR is one measure of solvent efficiency. Those skilled in the art will recognize that there are a multitude of other measures of solvent efficiency, such as the inverse of the OISR, or measures of solvent efficiency on a temporal basis that is different from the temporal basis discussed in this disclosure. Solvent recovery percentage is just one measure of solvent recovery. Those skilled in the art will recognize that there are many other measures of solvent recovery, such as the percentage loss, volume of unrecovered solvent per volume of recovered oil, or its inverse, the volume of produced oil to volume of lost solvent ratio (OLSR).

Solvent Composition

The solvent may be a light, but condensable, hydrocarbon or mixture of hydrocarbons comprising ethane, propane, or butane. Additional injectants may include $CO_2$, natural gas, $C_{3+}$ hydrocarbons, ketones, and alcohols. Non-solvent co-injectants may include steam, hot water, or hydrate inhibitors. Viscosifiers may be useful in adjusting solvent viscosity to reach desired injection pressures at available pump rates and may include diesel, viscous oil, bitumen, or diluent. Viscosifiers may also act as solvents and therefore may provide flow assurance near the wellbore and in the surface facilities in the event of asphaltene precipitation or solvent vaporization during shut-in periods. Carbon dioxide or hydrocarbon mixtures comprising carbon dioxide may also be desirable to use as a solvent.

In one embodiment, the solvent comprises greater than 50% $C_2$-$C_5$ hydrocarbons on a mass basis. In one embodiment, the solvent is primarily propane, optionally with diluent when it is desirable to adjust the properties of the injectant to improve performance. Alternatively, wells may be subjected to compositions other than these main solvents to improve well pattern performance, for example $CO_2$ flooding of a mature operation.

Phase of Injected Solvent

In one embodiment, the solvent is injected into the well at a pressure in the underground reservoir above a liquid/vapor phase change pressure such that at least 25 mass % of the solvent enters the reservoir in the liquid phase. Alternatively, at least 50, 70, or even 90 mass % of the solvent may enter the reservoir in the liquid phase. Injection as a liquid may be preferred for achieving high pressures because pore dilation at high pressures is thought to be a particularly effective mechanism for permitting solvent to enter into reservoirs filled with viscous oils when the reservoir comprises largely unconsolidated sand grains. Injection as a liquid also may allow higher overall injection rates than injection as a gas.

In an alternative embodiment, the solvent volume is injected into the well at rates and pressures such that immediately after halting injection into the injection well at least 25 mass % of the injected solvent is in a liquid state in the underground reservoir. Injection as a vapor may be preferred in order to enable more uniform solvent distribution along a horizontal well. Depending on the pressure of the reservoir, it may be desirable to significantly heat the solvent in order to inject it as a vapor. Heating of injected vapor or liquid solvent may enhance production through mechanisms described by "Boberg, T. C. and Lantz, R. B., "Calculation of the production of a thermally stimulated well", JPT, 1613-1623, December 1966. Towards the end of the injection cycle, a portion of the injected solvent, perhaps 25% or more, may become a liquid as pressure rises. Because no special effort is made to maintain the injection pressure at the saturation conditions of the solvent, liquefaction would occur through pressurization, not condensation. Downhole pressure gauges and/or reservoir simulation may be used to estimate the phase of the solvent and other co-injectants at downhole conditions and in the reservoir. A reservoir simulation is carried out using a reservoir simulator, a software program for mathematically modeling the phase and flow behavior of fluids in an underground reservoir. Those skilled in the art understand how to use a reservoir simulator to determine if 25% of the injectant would be in the liquid phase immediately after halting injection. Those skilled in the art may rely on measurements recorded using a downhole pressure gauge in order to increase the accuracy of a reservoir simulator. Alternatively, the downhole pressure gauge measurements may be used to directly make the determination without the use of reservoir simulation.

Although preferably a CSDRP is predominantly a non-thermal process in that heat is not used to reduce the viscosity of the viscous oil, the use of heat is not excluded. Heating may be beneficial to principally improve performance, improve process start-up or provide flow assurance during production. For start-p, low-level heating (for example, less than 100° C.) may be appropriate. Low-level heating of the solvent prior to injection may also be performed to prevent hydrate formation in tubulars and in the reservoir. Heating to higher temperatures may benefit recovery.

Embodiments of the instant invention are directed to limiting the formation of hydrates that may occur during oil recovery. In a CSDRP, these hydrates may be primarily located in the pore spaces of sediment layers adjacent to the wellbore. Alternatively, in a CSDRP, these hydrates may be located within the wellbore near the production zone and be caused by expansion cooling of solvent as it is produced back into the wellbore.

The formation of hydrates in or near the wellbore can be a significant risk for the operability of CSDRPs due to the fundamental nature of how CSDRPs operate. As described above, CSDRPs require injection of a solvent (typically a low carbon number hydrocarbon) into an oil, or viscous oil, reservoir at high pressure. Additionally, the reservoir will typically comprise live viscous oil that includes methane in solution.

The well then undergoes production of the solvent and dissolved viscous oil back to the injection well. It may be desirable to produce the reservoir to a low pressure during the production phase. If the pressure of the reservoir fluids is lowered below the bubble point of the solvent/viscous oil/methane mixture, gas will begin to evolve. Conservation of energy will dictate that evaporative cooling of the reservoir will occur. This cooling can significantly decrease the temperature of the reservoir rock and fluids. An example of a reservoir suitable for CSDRPs is in the Canadian oilsands where undisturbed in situ temperatures can range from 8 to 13° C. This temperature range is prone to hydrate formation. Hydrate control may be particularly important in reservoirs where the rock temperature is towards the low end of this range, such as in the Athabasca region of Canada where reservoir temperatures are often less than 10° C.

As outlined above, three factors combine to significantly increase the risk of hydrate formation for a CSDRP:

1. Use of a low molecular weight hydrocarbon (e.g. propane) as the solvent;
2. Evaporative cooling of the reservoir fluids and rock during the production phase; and
3. Low initial in situ reservoir temperatures.

Hydrate formation could cause plugging of the reservoir or plugging of the wellbore. In a non-cyclic solvent-dominated recovery process pilot carried out in Canada, using at least some propane as the solvent, hydrates were a significant problem (Black Laurel, "VAPEX—a new propane market," *Propane Canada*, May/June 2003). Unexpected production problems were caused by hydrate formation.

A preferred solvent for a CSDRP is propane, and propane-based hydrates can form at temperatures and pressures that are well within the operational range of a CSDRP. Additionally, it may be desirable to use another solvent, such as another low molecular weight (MW) hydrocarbon, or mixture of hydrocarbons. Likewise, the operating conditions of a CSDRP may involve lowering the reservoir pressure to achieve vaporization of the injected solvent during the production phase causing evaporative cooling of the reservoir.

These operating constraints, low MW hydrocarbon solvents, and operation below the bubble point of the solvent/viscous oil mixture, create conditions where the formation of hydrates are a concern.

There are numerous approaches to limit the creation of hydrates forming during oil production that have been described in the literature, see for example in Sloan Jr., E. D.; *Clathrate Hydrate of Natural Gasses* $2^{nd}$ ed.; Marcel Dekker, Inc.; New York; 1998, pp. 162, 170, 200-201, 269, 520. Most commonly, procedures used in the past involved the direct application of heat to move a process outside of hydrate formation conditions or the addition of a hydrate inhibitor (such as methanol, ethylene glycol, or a salt) while production is ongoing.

Direct application of heat or injection of hydrate inhibitor while production is ongoing is not preferred in CSDRPs because of the production process required for CSDRPs. Since CSDRPs are cyclic, during the production phase hydrates may form in the reservoir, outside of the wellbore. Therefore, it may not be practical to add a hydrate inhibitor without stopping production and without re-injecting inhibitor back into the reservoir. Moreover, the amount of inhibitor required may be substantial and hence costly to add. Adding an inhibitor to the wellbore may not be effective because of the risk that the hydrates will form in the reservoir. Also, adding heat to the reservoir during the production phase of a CSDRP would be difficult and would likely require expensive downhole heaters. It would also be difficult to heat a reservoir conductively from the wellbore against the flow of viscous oil and solvent.

Certain techniques have been proposed to produce naturally occurring in situ hydrates. The approaches often involve the application of heat (See for example U.S. Pat. Nos. 6,214,175; 6,978,837; and 7,165,621) to release gas trapped in hydrates. Other approaches have proposed the injection of heated hydrate inhibitors, such as salts and solvents (See for example U.S. Pat. Nos. 4,007,787 and 4,424,866). U.S. Pat. No. 4,007,787 describes the injection of a heated solvent into the hydrate stratum to convert hydrate water to liquid water.

In one embodiment of the instant invention, an energy carrying fluid is injected into an underground oil reservoir to limit the risk of subsequent hydrate formation during the production phase of a CSDRP. Energy can be stored in the reservoir near the wellbore and is then subsequently transferred to the produced fluid during the production phase. In this way, the reservoir will store thermal energy during the injection phase of a CSDRP and subsequently release that energy during the production phase to act against the evaporative cooling effect. In some embodiments, a viscosity-reducing solvent used in a CSDRP may also act as the energy carrying fluid.

In one embodiment, the heat is added to the fluid at the surface. This avoids the need for downhole equipment and allows the facilities to be skid mounted, which allows multiple wells, or pads, to be serviced by one skid. The production phase of a CSDRP is typically long relative to the injection phase. This means that any equipment used only for injection should be available for multiple wells. Heat losses will occur in the wellbore as the fluid is transported to the reservoir. One way to mitigate the heat losses is by injecting through a tubing string with the well annulus acting as insulation.

In some embodiments, control and monitoring of the injected fluid temperature and/or total energy injected may also be performed. This information is useful to determine whether sufficient energy has been stored in the reservoir to provide protection from hydrate formation during the production phase. Thermodynamic models and reservoir simulation that are well known to those skilled in the art may be used to predict minimum in situ temperatures, hydrate formation conditions, and expected production volumes. Using these results, the required energy storage during the injection phase can be estimated and optimized.

In some embodiments, the heating of the energy carrying fluid may be performed using a fired heater, an electric heater, heat exchange with hot flue gases from a steam boiler or gas turbine, or heat exchange with warm fluids produced from the reservoir or a neighboring reservoir region.

In one embodiment, the following steps are carried out:

1. Inject an energy carrying fluid into the reservoir in volumes, and at rates, which are ideal or suitable for the specific cycle of CSDRP;
2. The energy carrying fluid rapidly gives up its thermal energy as it travels through the cold reservoir creating a zone of heated reservoir rock and fluids in the near-wellbore region;
   a) The temperature of the fluid is selected to ensure sufficient energy is added to the reservoir during the injection phase. Reservoir simulation may be used to predict injection and production rates and volumes to estimate total energy injection and required downhole energy carrying fluid temperatures;
   b) Monitor actual temperatures and fluid injection rates to ensure sufficient energy is added;
3. Use appropriate wellbore design to reduce or minimize wellbore heat losses;
4. Begin production of viscous oil and solvent via the same well used for injection;
   a) Produce fluids at least part of the time at a pressure below the bubble point of the mixture thereby causing solvent to come out of solution as solvent vapour;
   b) Allow the stored thermal energy in the reservoir, adjacent to the wellbore, to act against the evaporative cooling effect and keep the production fluids above the hydrate formation temperature; and
5. Repeat for the next CSDRP cycle.

The expression "limit hydrate formation" is used herein to make clear that full prevention of hydrate formation is not necessary in all embodiments. It may not be possible to store enough energy to completely counteract the evaporative cooling. A certain amount of hydrate formation may be acceptable or tolerable. Also, even if enough thermal energy is stored to completely counteract the cooling, if the evaporative cooling is faster than the heat can transfer from the heated rock to the reservoir fluids, temperatures may drop into the hydrate formation regime. By monitoring the downhole production temperature, it may detected if the produced fluids are near the hydrate formation regime. If so, the production rate may be temporarily limited by raising the downhole pressure. Raising pressure and reducing rate reduces the amount of evaporative cooling, allowing time for the stored thermal energy to maintain the producing fluids above the hydrate formation temperature.

The following alternatives may also be employed.

(A) The temperature of the injected energy carrying fluid does not need to be a fixed value. The injection rate, injection duration, and injection temperature of the energy carrying fluid are dependant on several factors including heat transfer characteristics of the reservoir, anticipated injection/production cycle length, injection/production rate, injection/production volumes, downtime, or equipment limitations. Due to these parameters, it may not be optimal to inject fluid at a fixed temperature. The operating range of temperature could extend from reservoir temperature to the saturation temperature of the energy carrying fluid. Simulation could be used to determine the ideal temperature profile of the injected energy carrying fluid.

(B) In addition to the injection of the energy carrying fluid, it may also be desirable to inject hydrate inhibitor. If the injected energy-carrying fluid is water, water-soluble hydrate inhibitors such as methanol, ethylene glycol, or salts may be included. Even if the energy-carrying fluid is not water, it may still be desirable to inject hydrate inhibitors, including water-soluble inhibitors. The reservoir rock contains water with which the inhibitors may mix. The hydrate inhibitors may be injected separately from or together with the energy-carrying fluid.

(B) The fluid selected as the optimal solvent for CSDRP may not be the optimal energy carrying fluid for limiting hydrate formation. A different fluid may used as the energy carrier. For example, steam or hot water may be readily available in certain field operations. Periodically or continually injecting steam or hot (or warm) water along with a hydrocarbon solvent may act as the energy carrying fluid. In some cases, heated light oil may be available which can act as the energy carrying fluid. The appropriate energy carrier fluid would be based on availability, economics, heat transfer characteristics, and compatibility with facilities. However, the preferred embodiment is to use the same hydrocarbon solvent for the CSDRP also as the energy carrying fluid.

(C) Rather than injecting an energy-carrying fluid and/or subsequently further injecting a viscosity-reducing solvent, it may be preferable to circulate the energy-carrying fluid prior to subsequently further injecting a viscosity-reducing solvent. For example, the circulation (rather than injecting and not producing) of steam, hot water, hot diesel or hot solvent during a warm-up phase prior to the injection of a viscosity-reducing solvent.

(D) In addition to use in CSDRPs, any recovery process which undergoes in situ pressure swings that lead to evaporative cooling, where there is a risk of in situ hydrate formation could benefit from pre-heating of the reservoir or the adding of hydrate inhibitors to limit subsequent hydrate formation. Such process may include those with separate injection and production wells—e.g., solvent flooding where injection and production wells are periodically reversed.

(E) The energy carrying fluid will lose heat through the wellbore as it travels down the wellbore towards the reservoir. Excessive loss of heat through the wellbore reduces the capacity to deliver heat to the region mostly likely to form hydrates, the bottomhole wellbore region and adjacent formation. Reducing heat loss through the wellbore to non-reservoir rock is desirable. It may be advantageous to inject heated solvent at a higher temperature at the end of the cycle rather than inject the same quantity of heat at a lower temperature over the entire solvent injection period. Other methods for reducing heat losses include the use of insulated tubing, a small diameter injection tubing string and/or a (low pressure) nitrogen blanket in an annulus.

(F) The heating of the fluids may be via downhole equipment. The appeal of such an approach depends on many factors including cost, heat transfer characteristics, and facilities limitations. The benefit would be the limitation of wellbore heat losses.

Numerical Simulations of an Embodiment

Thermal reservoir simulations have shown that for a CSDRP process, the injection of reservoir temperature solvent (13° C.) will result in a cool region in the near-wellbore region during the following production phase. As mentioned above, the cool region forms due to evaporative cooling when the solvent and/or light gases, such as methane, evolves from the oil phase. The cool zone forms immediately adjacent to the wellbore and there are areas within this zone where the temperature and pressure are within the hydrate formation conditions for the propane/water system. The size and shape of the region will be dependant on many factors including solvent type, temperature, injection and production strategies, and others.

Thermal reservoir simulations were also completed where the injected solvent was heated to 25° C. The initial reservoir temperature was 13° C. These simulations showed that the energy contained in the warm solvent was transferred to the reservoir near the well bore at the end of injection. At the end of injection, a warm zone was created immediately adjacent to the well bore with temperatures up to the solvent injection temperature. During the subsequent production phase, the energy required to vaporize the solvent was taken from the adjacent fluid and rock, as with the unheated simulation. The energy stored in the reservoir during the injection phase was sufficient to counteract the evaporative cooling effect and prevent the temperature from dropping into hydrate formation conditions. The reservoir was at nearly uniform temperature at the end of the simulated production cycle with no regions within the reservoir existing at temperature and pressures within the hydrate formation conditions.

To illustrate the benefit of heat addition to the water-propane system in a cyclic process, a schematic representation is presented in FIG. 1 showing the reservoir temperature and pressure conditions during a cycle. Line 23 represents the phase envelope between hydrate conditions and non-hydrate conditions in the reservoir. Without hydrate control, the process proceeds as follows (referring to dashed lines 20 and 21):

1. Initial conditions represented by point 10 in FIG. 1;
2. Injection phase pressurizes the reservoir from point 10 to point 11;
3. Production phase depressurizes the reservoir from point 11 to point 12;
4. After the bubble point of the solvent/bitumen mixture is reached, evaporative cooling will cool the reservoir from point 12 to point 13; and
5. With continued production, hydrate formation conditions are achieved (point 14).

Using an embodiment of the present invention, hydrate formation is controlled and the process proceeds as follows (solid line 22):

1. Initial conditions represented by point 10 on in FIG. 1;
2. Injection phase pressurizes and warms the reservoir slightly, point 10 to point 17;
3. Production phase depressurizes and slightly cools the reservoir, point 17 to point 18;
4. When the bubble point of the solvent/bitumen mixture is reached, evaporative cooling enhances the cooling of the reservoir, point 18 to point 19; and
5. With continued production the cooling effect is offset by the energy stored during the injection phase to maintain conditions outside of hydrate formation conditions, point 19 to point 10.

Table 1 outlines the operating ranges for CSDRPs of some embodiments. The present invention is not intended to be limited by such operating ranges.

TABLE 1

Operating Ranges for a CSDRP.

| Parameter | Broader Embodiment | Narrower Embodiment |
|---|---|---|
| Injectant volume | Fill-up estimated pattern pore volume plus 2-15% of estimated pattern pore volume; or inject, beyond a pressure threshold, for a period of time (e.g. weeks to months); or inject, beyond a pressure threshold, 2-15% of estimated pore volume. | Inject, beyond a pressure threshold, 2-15% (or 3-8%) of estimated pore volume. |
| Injectant composition, main | Main solvent (>50 mass %) $C_2$-$C_5$. Alternatively, wells may be subjected to compositions other than main solvents to improve well pattern performance (i.e. $CO_2$ flooding of a mature operation or altering in-situ stress of reservoir). | Main solvent (>50 mass %) is propane ($C_3$). |
| Injectant composition, additive | Additional injectants may include $CO_2$ (up to about 30%), $C_{3+}$, viscosifiers (e.g. diesel, viscous oil, bitumen, diluent), ketones, alcohols, sulphur dioxide, hydrate inhibitors, and steam. | Only diluent, and only when needed to achieve adequate injection pressure. |

TABLE 1-continued

Operating Ranges for a CSDRP.

| Parameter | Broader Embodiment | Narrower Embodiment |
|---|---|---|
| Injectant phase & Injection pressure | Solvent injected such that at the end of injection, greater than 25% by mass of the solvent exists as a liquid in the reservoir, with no constraint as to whether most solvent is injected above or below dilation pressure or fracture pressure. | Solvent injected as a liquid, and most solvent injected just under fracture pressure and above dilation pressure, $P_{fracture} > P_{injection} > P_{dilation} > P_{vaporP}$. |
| Injectant temperature | Enough heat to prevent hydrates and locally enhance wellbore inflow consistent with Boberg-Lantz mode | Enough heat to prevent hydrates with a safety margin, $T_{hydrate}$ + 5° C. to $T_{hydrate}$ + 50° C. |
| Injection rate | 0.1 to 10 $m^3$/day per meter of completed well length (rate expressed as volumes of liquid solvent at reservoir conditions). | 0.2 to 2 $m^3$/day per meter of completed well length (rate expressed as volumes of liquid solvent at reservoir conditions). Rates may also be designed to allow for limited or controlled fracture extent, at fracture pressure or desired solvent conformance depending on reservoir properties. |
| Threshold pressure (pressure at which solvent continues to be injected for either a period of time or in a volume amount) | Any pressure above initial reservoir pressure. | A pressure between 90% and 100% of fracture pressure. |
| Well length | As long of a horizontal well as can practically be drilled; or the entire pay thickness for vertical wells. | 500 m-1500 m (commercial well). |
| Well configuration | Horizontal wells parallel to each other, separated by some regular spacing of 60-600 m; Also vertical wells, high angle slant wells & multi-lateral wells. Also infill injection and/or production wells (of any type above) targeting bypassed hydrocarbon from surveillance of pattern performance. | Horizontal wells parallel to each other, separated by some regular spacing of 60-320 m. |
| Well orientation | Orientated in any direction. | Horizontal wells orientated perpendicular to (or with less than 30 degrees of variation) the direction of maximum horizontal in-situ stress. |
| Minimum producing pressure (MPP) | Generally, the range of the MPP should be, on the low end, a pressure significantly below the vapor pressure, ensuring vaporization; and, on the high-end, a high pressure near the native reservoir pressure. For example, perhaps 0.1 MPa-5 MPa, depending on depth and mode of operation (all-liquid or limited vaporization). | A low pressure below the vapor pressure of the main solvent, ensuring vaporization, or, in the limited vaporization scheme, a high pressure above the vapor pressure. At 500 m depth with pure propane, 0.5 MPa (low)-1.5 MPa (high), values that bound the 800 kPa vapor pressure of propane. |
| Oil rate | Switch to injection when rate equals 2 to 50% of the max rate obtained during the cycle; Alternatively, switch when absolute rate equals a pre-set value. Alternatively, well is unable to sustain hydrocarbon flow (continuous or intermittent) by primary production against backpressure of gathering system or well is "pumped off" unable to sustain flow from artificial lift. Alternatively, well is out of sync with adjacent well cycles. | Switch when the instantaneous oil rate declines below the calendar day oil rate (CDOR) (e.g. total oil/total cycle length). Likely most economically optimal when the oil rate is at about 0.8 × CDOR. Alternatively, switch to injection when rate equals 20-40% of the max rate obtained during the cycle. |

TABLE 1-continued

Operating Ranges for a CSDRP.

| Parameter | Broader Embodiment | Narrower Embodiment |
|---|---|---|
| Gas rate | Switch to injection when gas rate exceeds the capacity of the pumping or gas venting system. Well is unable to sustain hydrocarbon flow (continuous or intermittent) by primary production against backpressure of gathering system with/or without compression facilities. | Switch to injection when gas rate exceeds the capacity of the pumping or gas venting system. During production, an optimal strategy is one that limits gas production and maximizes liquid from a horizontal well. |
| Oil to Solvent Ratio | Begin another cycle if the OISR of the just completed cycle is above 0.15 or economic threshold. | Begin another cycle if the OISR of the just completed cycle is above 0.3. |
| Abandonment pressure (pressure at which well is produced after CSDRP cycles are completed) | Atmospheric or a value at which all of the solvent is vaporized. | For propane and a depth of 500 m, about 340 kPa, the likely lowest obtainable bottomhole pressure at the operating depth and well below the value at which all of the propane is vaporized. |

In Table 1, embodiments may be formed by combining two or more parameters and, for brevity and clarity, each of these combinations will not be individually listed.

In the context of this specification, diluent means a liquid compound that can be used to dilute the solvent and can be used to manipulate the viscosity of any resulting solvent-bitumen mixture. By such manipulation of the viscosity of the solvent-bitumen (and diluent) mixture, the invasion, mobility, and distribution of solvent in the reservoir can be controlled so as to increase viscous oil production.

The diluent is typically a viscous hydrocarbon liquid, especially a $C_4$ to $C_{20}$ hydrocarbon, or mixture thereof, is commonly locally produced and is typically used to thin bitumen to pipeline specifications. Pentane, hexane, and heptane are commonly components of such diluents. Bitumen itself can be used to modify the viscosity of the injected fluid, often in conjunction with ethane solvent.

In certain embodiments, the diluent may have an average initial boiling point close to the boiling point of pentane (36° C.) or hexane (69° C.) though the average boiling point (defined further below) may change with reuse as the mix changes (some of the solvent originating among the recovered viscous oil fractions). Preferably, more than 50% by weight of the diluent has an average boiling point lower than the boiling point of decane (174° C.). More preferably, more than 75% by weight, especially more than 80% by weight, and particularly more than 90% by weight of the diluent, has an average boiling point between the boiling point of pentane and the boiling point of decane. In further preferred embodiments, the diluent has an average boiling point close to the boiling point of hexane (69° C.) or heptane (98° C.), or even water (100° C.).

In additional embodiments, more than 50% by weight of the diluent (particularly more than 75% or 80% by weight and especially more than 90% by weight) has a boiling point between the boiling points of pentane and decane. In other embodiments, more than 50% by weight of the diluent has a boiling point between the boiling points of hexane (69° C.) and nonane (151° C.), particularly between the boiling points of heptane (98° C.) and octane (126° C.).

By average boiling point of the diluent, we mean the boiling point of the diluent remaining after half (by weight) of a starting amount of diluent has been boiled off as defined by ASTM D 2887 (1997), for example. The average boiling point can be determined by gas chromatographic methods or more tediously by distillation. Boiling points are defined as the boiling points at atmospheric pressure.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

The invention claimed is:

1. A method for limiting hydrate formation during hydrocarbon production from an underground hydrocarbon reservoir using a production method involving solvent injection and cycling of in situ pressure, the method comprising:

(a) estimating a minimum quantity of thermal energy required to heat a near-wellbore region to a temperature above a hydrate formation temperature of a composition to be produced in subsequent production of hydrocarbons, wherein the temperature remains above the hydrate formation temperature during at least a portion of the subsequent production of hydrocarbons;

(b) injecting a viscosity-reducing solvent into the underground hydrocarbon reservoir through a wellbore;

(c) injecting a thermal energy carrying fluid into the underground hydrocarbon reservoir through the wellbore at least until the estimated minimum quantity of thermal energy required to heat the near-wellbore region to the temperature above the hydrate formation temperature has been introduced; and (d) subsequently producing hydrocarbons from the underground hydrocarbon reservoir though the wellbore.

2. The method of claim 1, wherein the estimating step comprises determining, by physical measurement or simulation, the minimum quantity of thermal energy, wherein the step of injecting the thermal energy carrying fluid is performed based on this minimum quantity of thermal energy.

3. The method of claim 1, wherein the estimating step comprises determining a minimum temperature to be reached in the near-wellbore region indicating that the estimated minimum quantity of thermal energy has been introduced, and wherein the step of injecting the thermal energy carrying fluid is performed at least until the minimum temperature has been reached.

4. The method of claim 3, further comprising estimating the minimum temperature using a thermal reservoir simulation.

5. The method of claim 1, wherein the estimated minimum quantity of thermal energy is a quantity of energy required to prevent the formation of hydrates during subsequent fluid production.

6. The method of claim 5, wherein the estimating step comprises estimating a cooling effect caused by in situ vaporization of the viscosity-reducing solvent during planned cycling of in situ pressure.

7. The method of claim 5, wherein the estimated minimum quantity of thermal energy is a quantity of energy required to heat the near-wellbore region to a temperature above the hydrate formation temperature and to counteract a cooling effect caused by in situ vaporization of the solvent during planned cycling of in situ pressure such that, during production, the near-wellbore region remains above the hydrate formation temperature.

8. The method of claim 1, wherein the hydrocarbons are a viscous oil having an in situ viscosity of at least 10 cP at initial reservoir conditions.

9. The method of claim 1, wherein production rate is temporarily limited in order to reduce an amount of cooling caused by in situ vaporization of the viscosity-reducing solvent.

10. The method of claim 1, wherein the thermal energy carrying fluid is heated solvent and comprises at least a portion of the viscosity-reducing solvent in step (b) of claim 1.

11. The method of claim 1, further comprising introducing the heat by way of the thermal energy carrying fluid after a majority of the viscosity-reducing solvent in step (b) of claim 1 has been injected.

12. The method of claim 1, further comprising introducing the heat by way of heating fluids in the near-wellbore region via downhole equipment.

13. The method of claim 1, wherein the thermal energy carrying fluid comprises a species selected from the group consisting of heated ethane, propane, butane, pentane, hexane, heptane, $CO_2$, or a mixture thereof.

14. The method of claim 1, wherein the viscosity-reducing solvent comprises a species selected from the group consisting of ethane, propane, butane, pentane, hexane, heptane, $CO_2$, or a mixture thereof.

15. The method of claim 1, wherein at least a portion of the viscosity-reducing solvent enters the underground hydrocarbon reservoir in a liquid state.

16. The method of claim 1, wherein the thermal energy carrying fluid comprises greater than 50 mass % water or steam.

17. The method of claim 1, wherein a hydrate inhibitor is injected separately from or together with the thermal energy carrying fluid.

18. The method of claim 17, wherein the hydrate inhibitor is an alcohol, glycol, or salt.

19. The method of claim 1, wherein subsequently producing hydrocarbons comprises (i) injecting a volume of fluid comprising greater than 50 mass % of the viscosity-reducing solvent into an injection well completed in the underground hydrocarbon reservoir;

(ii) halting injection into the injection well and subsequently producing at least a fraction of the injected fluid and the hydrocarbons from the underground hydrocarbon reservoir through a production well;

(iii) halting production through the production well; and (iv) subsequently repeating the cycle of steps (i) to (iii).

20. The method of claim 19, wherein the injection well and the production well utilize a common wellbore.

21. The method of claim 1, further comprising monitoring at least one downhole temperature to determine a desired energy carrying fluid injection temperature.

22. The method of claim 1, wherein immediately after halting injection, at least 25 mass % of the viscosity-reducing solvent is in a liquid state in the underground hydrocarbon reservoir.

23. The method of any claim 1, wherein at least 25 mass % of the viscosity-reducing solvent enters the underground hydrocarbon reservoir as a liquid.

24. The method of claim 1, wherein at least 50 mass % of the viscosity-reducing solvent enters the underground hydrocarbon reservoir as a liquid.

25. The method of claim 1, wherein the solvent comprises a species selected from the group consisting of ethane, propane, butane, pentane, carbon dioxide, or a combination thereof.

26. The method of claim 1, wherein the viscosity-reducing solvent comprises greater than 50 mass % propane.

27. A method for limiting hydrate formation during hydrocarbon production from an underground hydrocarbon reservoir using a production method involving solvent injection and cycling of in situ pressure, the method comprising:

(a) estimating a minimum quantity of thermal energy required to heat a near-wellbore region to a temperature above a hydrate formation temperature of a composition to be produced in subsequent production;

(b) injecting a viscosity-reducing solvent into the underground hydrocarbon reservoir through a wellbore;

(c) injecting a thermal energy carrying fluid into the underground hydrocarbon reservoir through the wellbore at least until the estimated minimum quantity of thermal energy required to heat the near-wellbore region to the temperature above the hydrate formation temperature has been introduced; and (d) subsequently producing hydrocarbons from the underground hydrocarbon reservoir though the wellbore, wherein a production rate of producing hydrocarbons is temporarily limited in order to reduce an amount of cooling caused by in situ vaporization of the viscosity-reducing solvent.

28. A method for limiting hydrate formation during hydrocarbon production from an underground hydrocarbon reservoir using a production method involving solvent injection and cycling of in situ pressure, the method comprising:

(a) estimating a minimum quantity of thermal energy required to heat a near-wellbore region to a temperature above a hydrate formation temperature of a composition to be produced in subsequent production;

(b) injecting a viscosity-reducing solvent into the underground hydrocarbon reservoir through a wellbore;

(c) injecting a thermal energy carrying fluid into the underground hydrocarbon reservoir through the wellbore at least until the estimated minimum quantity of thermal energy required to heat the near-wellbore region to the temperature above the hydrate formation temperature has been introduced;

(d) subsequently producing hydrocarbons from the underground hydrocarbon reservoir though the wellbore; and (e) introducing the heat by way of the thermal energy carrying fluid after a majority of the viscosity-reducing solvent has been injected.

* * * * *